US011135112B1

(12) United States Patent
Winfree et al.

(10) Patent No.: US 11,135,112 B1
(45) Date of Patent: Oct. 5, 2021

(54) MULTI-ROOM IN-HOME HARNESS SYSTEM

(71) Applicants: Arizona Board of Regents acting for and on behalf of Northern Arizona University, Flagstaff, AZ (US); University of Delaware, Newark, DE (US)

(72) Inventors: Kyle N. Winfree, Flagstaff, AZ (US); James Cole Galloway, Flagstaff, AZ (US)

(73) Assignees: Arizona Board of Regents acting for and on behalf of Northern Arizona University, Flagstaff, AZ (US); University of Delaware, Newark, DE (US)

( * ) Notice: Subject to any disclaimer, the term of this patent is extended or adjusted under 35 U.S.C. 154(b) by 0 days.

(21) Appl. No.: 16/384,404

(22) Filed: Apr. 15, 2019

Related U.S. Application Data

(60) Provisional application No. 62/657,568, filed on Apr. 13, 2018.

(51) Int. Cl.
*A61G 7/10* (2006.01)

(52) U.S. Cl.
CPC ..... *A61G 7/1034* (2013.01); *A61G 7/1042* (2013.01); *A61G 7/1051* (2013.01); *A61G 7/1076* (2013.01); *A61G 7/1015* (2013.01); *A61G 2203/36* (2013.01); *A61G 2203/80* (2013.01)

(58) Field of Classification Search
CPC ..... A61G 7/10; A61G 7/1015; A61G 7/1034; A61G 7/1051; A61G 7/1053; A61G 7/1065; A61G 7/1042; A61G 7/1076; A61G 2203/36; A61G 2203/80; A61H 3/008
See application file for complete search history.

(56) References Cited

U.S. PATENT DOCUMENTS 3,761,082 A * 9/1973 Barthel, Jr. ..... A61H 3/008 482/69
6,532,607 B1 * 3/2003 Heil ..... A61G 7/1015 128/845
7,938,757 B1 * 5/2011 Cockrell ..... A61H 3/008 182/37
9,089,465 B2 7/2015 Galloway et al.
(Continued)

OTHER PUBLICATIONS

Agrawal, et al., Design of Gravity Balancing Leg Orthosis Using Non-zero Free Length Springs, Mechanism and Machine Theory, 40(6), 2005, 693-709. http://doi.org/10.1016/j.mechmachtheory. 2004. 11.002.

(Continued)

*Primary Examiner* — Jennifer Robertson
(74) *Attorney, Agent, or Firm* — Adam R. Stephenson, Ltd.

(57) ABSTRACT

A multi-room in-home harness system is disclosed. Specific implementations may include a first plurality of tracks including a first track system in a first room, a trolley that may be configured to moveably couple to a track of the first plurality of tracks and move along a horizontal plane of the track, and a cart coupled to the trolley, where the trolley may be configured to move the cart along each track of the first plurality of tracks and may also be configured to transfer the cart from the first plurality of tracks to a second plurality of tracks in a second room.

18 Claims, 9 Drawing Sheets

(56) References Cited

U.S. PATENT DOCUMENTS

| | | | | |
|---|---|---|---|---|
| 9,682,000 | B2 * | 6/2017 | Behnke | A63B 21/00181 |
| 10,500,123 | B2 * | 12/2019 | Glukhovsky | E01B 25/26 |
| 2004/0074414 | A1 * | 4/2004 | Phillips | B61B 3/00 104/93 |
| 2006/0189453 | A1 * | 8/2006 | Leblond | A63B 69/18 482/69 |
| 2011/0000015 | A1 * | 1/2011 | Faucher | A61G 7/1042 5/83.1 |
| 2012/0000876 | A1 * | 1/2012 | Bergenstrale | B66C 7/02 212/336 |
| 2012/0046578 | A1 | 2/2012 | Agrawal | |
| 2012/0325586 | A1 * | 12/2012 | Meggs | A61G 7/1042 182/231 |
| 2014/0201905 | A1 * | 7/2014 | Glukhovsky | A61G 7/1049 5/81.1 R |
| 2014/0201906 | A1 * | 7/2014 | Erturk | A61G 7/1001 5/81.1 R |
| 2014/0206503 | A1 * | 7/2014 | Stockmaster | A61H 3/008 482/4 |
| 2015/0143627 | A1 * | 5/2015 | McBride | A61H 3/008 5/81.1 R |
| 2016/0256346 | A1 * | 9/2016 | Stockmaster | A61B 5/1117 |
| 2017/0087392 | A1 * | 3/2017 | Lambert | A61H 3/008 |
| 2017/0128313 | A1 * | 5/2017 | Glukhovsky | E01B 25/26 |
| 2018/0071159 | A1 * | 3/2018 | Glukhovsky | A61G 7/1049 |

OTHER PUBLICATIONS

Agrawal, et al., Design of a Novel Two Degree-of-Freedom Ankle-Foot Orthosis, Journal of Mechanical Design, 129(11), 2007, 1137. http://doi.org/10.1115/1.2771231.

Barbeau, et al., Optimal Outcomes Obtained with Body-Weight Support Combined with Treadmill Training in Stroke Subjects, No commercial party having a direct financial interest in the results of the research supporting this article has or will confer a benefit upon the aut. Archives of Physical Medicine and Rehabilitation, 84(10), 2003, 1458-1465. http://doi.org/10.1016/S0003-9993(03)00361-7.

Burnfield, et al., Partial Body Weight Support Treadmill Training Speed Influences Paretic and Non-paretic Leg Muscle Activation, Stride Characteristics, and Ratings of Perceived Exertion During Acute Stroke Rehabilitation, Human Movement Science, 47, 2016, 16-28. http://doi.org/10.1016/j.humov.2016.01.012.

Chen, et al., Gait Differences Between Individuals with Post-stroke Hemiparesis and Non-disabled Controls at Matched Speeds, Gait and Posture, 22(1), 2005, 51-56. http://doi.org/10.1016/j.gaitpost.2004.06.009.

Chen, et al., Gait Deviations Associated with Post-stroke Hemiparesis: Improvement During Treadmill Walking Using Weight Support, Speed, Support Stiffness, and Handrail Hold, Gait and Posture, 22(1), 2005, 57-62. http://doi.org/10.1016/j.gaitpost.2004.06.008.

Ciou,et al., Balance Training Using an Interactive Game to Enhance the Use of the Affected Side After Stroke, Journal of Physical Therapy Science, 27(12), 2005, 3855-61. http://doi.org/10.1589/jpts.27.3855.

Dickstein, Rehabilitation of Gait Speed After Stroke: A Critical Review of Intervention Approaches, Neurorehabilitation and Neural Repair. 2008, http://doi.org/10.1177/1545968308315997.

Fattah, et al., Design of a Passive Gravity-Balanced Assistive Device for Sit-to-Stand Tasks, Journal of Mechanical Design, 128(5), 2006, 1122. http://doi.org/10.1115/1.2216732.

Freudenberger, et al., Fitness and cognition in the elderly: The Austrian Stroke Prevention Study. Neurology, 86(5), 2016, 418-424. http://doi.org/10.1212/WNL.0000000000002329.

Frey, et al., A Novel Mechatronic Body Weight Support System, IEEE Transactions on Neural Systems and Rehabilitation Engineering: A Publication of the IEEE Engineering in Medicine and Biology Society, 14(3), 2006, 311-21. http://doi.org/10.1109/TNSRE.2006.881556.

Services, U. D. of H. and H., 2014, Post-Stroke Rehabilitation, Nih, Retrieved from http://stroke.nih.gov/materials/rehabilitation.htm.

Valentine, et al., Biographical Narratives of Encounter: The Significance of Mobility and Emplacement in Shaping Attitudes towards Difference, Urban Studies, 51(9), 2014, 1979-1994. http://doi.org/10.1177/0042098013504142.

Vance, et al., Physical Activity and Cognitive Function in Older Adults, Journal of Neuroscience Nursing, 48(4), 2016, E2-E12. http://doi.org/10.1097/JNN.0000000000000197.

Escarzaga, et al., Design of a Sit-to-stand In-home Body Weight Support System, preprint submitted to 40th Annual International conference of the IEEE Engineering in Medicine and Biology Society, Feb. 16, 2018, 4 pages.

* cited by examiner

MULTI-ROOM IN-HOME HARNESS SYSTEM

CROSS REFERENCE TO RELATED APPLICATIONS

This document claims the benefit of the filing date of U.S. Provisional Patent Application 62/657,568, entitled "Multi-Room In-Home Harness System" to Winfree et al, which was filed on Apr. 13, 2018, the disclosure of which is hereby incorporated entirely herein by reference.

BACKGROUND

1. Technical Field

Aspects of this document relate generally to harness systems used for the rehabilitation or movement of individuals with limited mobility. More specific implementations include a multi-room harness system.

2. Background

Harness systems have been used to support individuals with limited mobility using a structure that wraps around the person and provides at least some support for their weight.

SUMMARY

Implementations of a multi-room harness system may include: a first plurality of tracks including a first track system in a first room; a trolley that may be configured to moveably couple to a track of the first plurality of tracks and move along a horizontal plane of the track; and a cart coupled to the trolley; where the trolley may be configured to move the cart along each track of the first plurality of tracks and may also be configured to transfer the cart from the first plurality of tracks to a second plurality of tracks in a second room.

Implementations of a multi-room harness system may include one, all, or any of the following:

The trolley may also be configured to move the cart along each track of the second plurality of tracks in the second room.

The trolley may include a motor that may be configured to move the trolley along the horizontal plane of the track.

The motor may be controlled using a microcontroller.

The cart may include a body weight support (BWS) system that may be configured to support the weight of a person.

The first plurality of tracks may include a first plurality of I-beams, where a first I-beam of the first plurality of I-beams may be configured to couple to a second I-beam of the first plurality of I-beams.

The second plurality of tracks may include a second plurality of I-beams, where a first I-beam of the second plurality of I-beams may be configured to couple to a second I-beam of the second plurality of I-beams and may be configured to couple to the second I-beam of the first plurality of I-beams.

The trolley may be configured to transfer the cart from the second I-beam of the first plurality of I-beams to the first I-beam of the second plurality of I-beams.

Implementations of a multi-room harness system may also include: a first plurality of I-beams in a first room, where a first I-beam of the plurality of I-beams may be configured to couple to a second I-beam of the first plurality of I-beams; a trolley that may be configured to moveably couple to an I-beam of the first plurality of I-beams and move along a horizontal plane of the I-beam; and a cart coupled to the trolley; where the trolley may be configured to move the cart along the first I-beam of the plurality of I-beams and may also be configured to transfer the cart from the second I-beam of the first plurality of I-beams to a first I-beam of a second plurality of I-beams in a second room.

Implementations of the multi-room harness system may also include one, all, or any of the following:

The trolley may include a motor that may be configured to move the trolley along the horizontal plane of the I-beam.

The motor may be controlled using a microcontroller or other electronic control system.

The cart may include a body weight support (BWS) system that may be configured to support the weight of a person.

A plurality of sensors may be configured to sense a movement and a position of the cart.

Implementations of a multi-room harness system may also include: a first plurality of tracks including a first track system in a first room; a trolley that may be configured to moveably couple to a track of the first plurality of tracks and move along a horizontal plane of the track; and a cart coupled to the trolley; where the first plurality of tracks may be configured to be alignable with a second plurality of tracks in a second room that may allow the trolley to transfer the cart from the first plurality of tracks to the second plurality of tracks.

Implementations of the multi-room harness system may also include one, all, or any of the following:

The track of the first plurality of tracks may be rotationally alignable with a track of the second plurality of tracks.

A plurality of sensors may be configured to sense a movement and a position of the cart.

The trolley may include a motor that may be configured to move the trolley along the horizontal plane of the track.

The first plurality of tracks may include a first plurality of I-beams, where a first I-beam of the first plurality of I-beams may be configured to couple to a second I-beam of the first plurality of I-beams.

The second plurality of tracks may include a second plurality of I-beams, where a first I-beam of the second plurality of I-beams may be configured to couple to a second I-beam of the second plurality of I-beams and may be configured to couple to the second I-beam of the first plurality of I-beams.

The trolley may be configured to transfer the cart from the second I-beam of the first plurality of I-beams to the first I-beam of the second plurality of I-beams.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended multi-room in-home harness system will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such multi-room in-home harness systems, and implementing components and methods, consistent with the intended operation and methods.

Particular implementations of multi-room harness systems that allow for a large workspace and offer a variable degree of body support that closely match the needs of a person with limited mobility are disclosed and described in this document. While the harness systems disclosed herein are primarily referred to as being used within a home, it is understood that the harness systems disclosed herein may be used in a variety of structures and settings, such as, by non-limiting example, workplaces, public transport, hospitals, nursing homes, and other places where individuals needing support may be found.

In various implementations, the harness system may include a plurality of tracks fixedly, removably fixedly, or rotatably attached to the ceiling and/or walls of a home. In various implementations, a trolley is movably coupled to the tracks and moves along the tracks. Specifically, the trolley may roll, slide, or move in any other manner along the tracks. A cart configured to support a person may be coupled to the trolley. In such implementations, the person within the cart may be able to be supported through the trolley and the tracks attached to the ceiling and/or walls while walking through a home. In various implementations, a home may include a single cart (or multiple carts) which are able to move through a single or multiple rooms in a home via a track system that extends through multiple rooms in a home.

Figure 1:
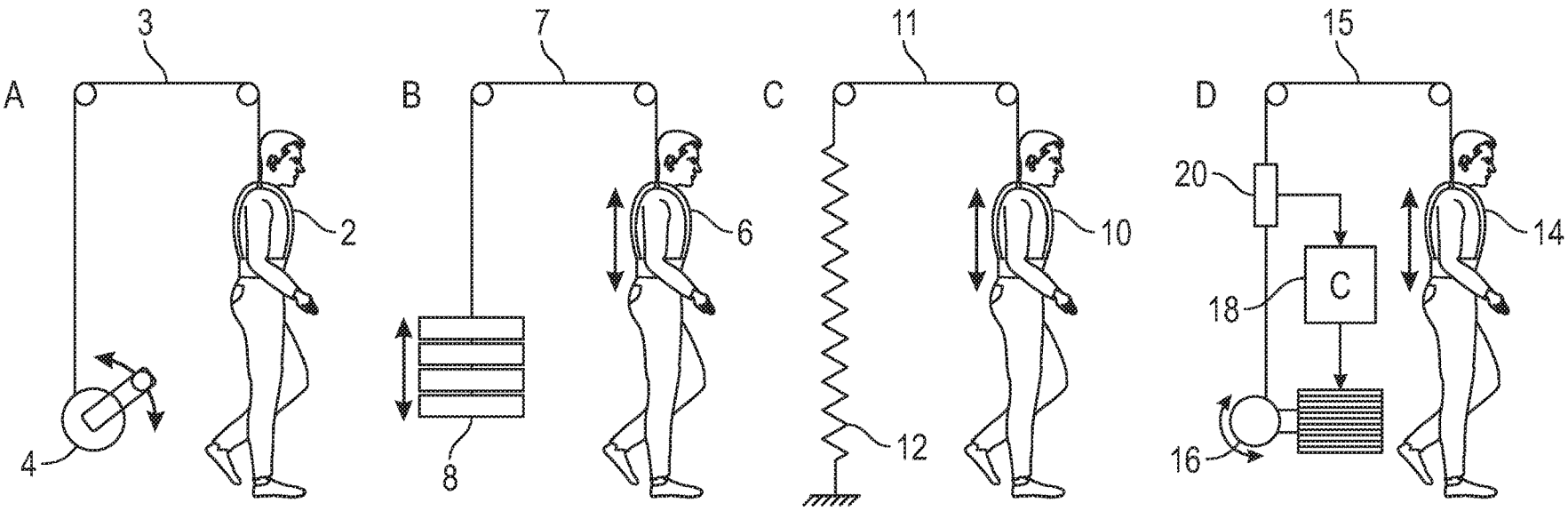
FIG. 1 illustrates four implementations of a body weight support system.

Referring now to FIG. 1, four implementations of a body weight support (BWS) system are illustrated. In various implementations, any of these various body weight support system implementations may be included in various implementations of the multi-room harness system. As illustrated, implementation A includes a winch 4 coupled to a cart 2. In various implementations, the winch 4 may be operated manually or electronically with a motor. In various implementations, the cart 2 may form a harness capable of supporting the weight of a person. In such implementations, the harness may wrap around the person supporting the person's torso, or it may form a seat for a person, or both. As illustrated, the winch may be coupled to the cart 2 by a cable 3. In various implementations, by non-limiting example, the cable 3 may be a rope, wire, or other material capable of supporting the weight of a person. As illustrated, implementation B includes a cart 6 coupled to a counterweight 8 by a cable 7. In various implementations, the counterweight 8 may be adjustable to provide the appropriate weight balance for different persons. As illustrated, implementation C includes a cart 10 coupled to a spring 12 by a cable 11. In various implementations, the spring may be constructed of elastic, or other stretchable material, capable of providing a counterbalance effect to the person in the cart 10. As illustrated, implementation D includes a cart 14 coupled to a force sensor 20 by a cable 15. In various implementations, the force sensor 20 may sense the amount of force produced by the weight along the cable 15 from the person in the cart 14. In such implementations, the force sensor 20 may signal a controller 18 to compensate for movements or weight changes of the person in the cart 14 by adjusting the position/movement of the weight. Further, in such implementations, the controller 18 may signal an actuator 16 to provide more or less counterweight, or to move the cable 15, allowing the movement of the cart 14 in various directions. In various implementations, the operation of the controller 18 and the actuator 16 may be manually operated by use of a personal computing device, or it may be operated autonomously, using the force sensor 20 or other sensors.

Figure 2:
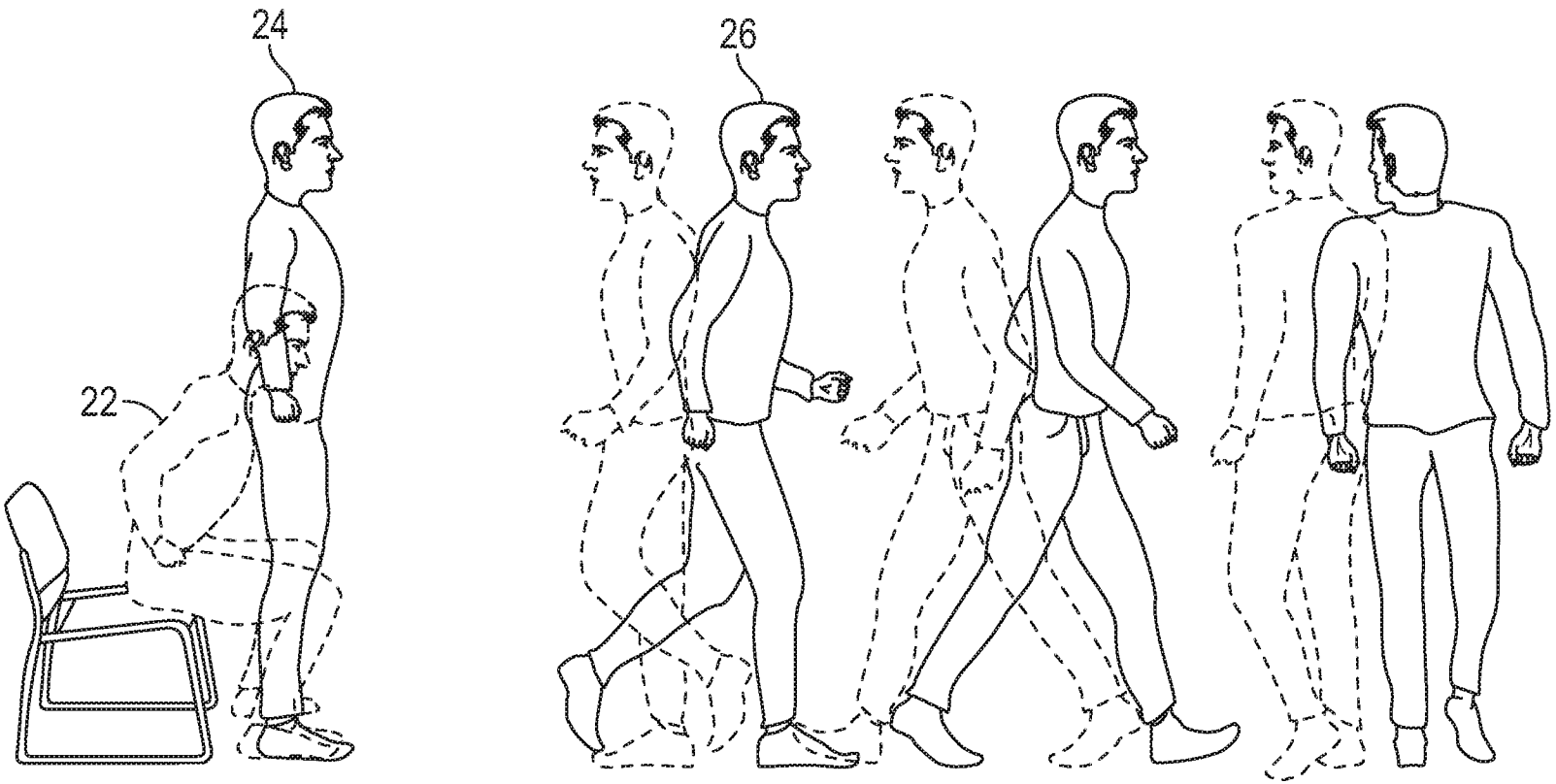
FIG. 2 illustrates various transitional movements of a person that may require the support of a body weight support system.

Referring to FIG. 2, examples of transitional movements of a person that may require the support of a body weight support system are illustrated. A person will require different levels of body weight support when sitting as compared to standing and walking. As illustrated, the person will require varying degrees of support while transitioning from a sitting position 22 to a standing position 24, from a standing position 24 to a sitting position 22, from a standing position 24 to a walking position 26, and from a walking position 26 to a standing position 24. In various implementations, to accommodate such needs, the multi-room harness system may utilize a lever arm concept of a zero-length spring system, which may be able to provide a more constant force independent of position. Further, in particular implementations, the system may include a set of cams and levers such that the applied support is constant for the range of standing to near squatting, but then diminishes once a person is sitting. In addition to this, in various implementations, the body weight support (BWS) system may minimalize any negative inertia and frictional effects of the system to provide comfort and proper body weight support to the person.

Figure 3:
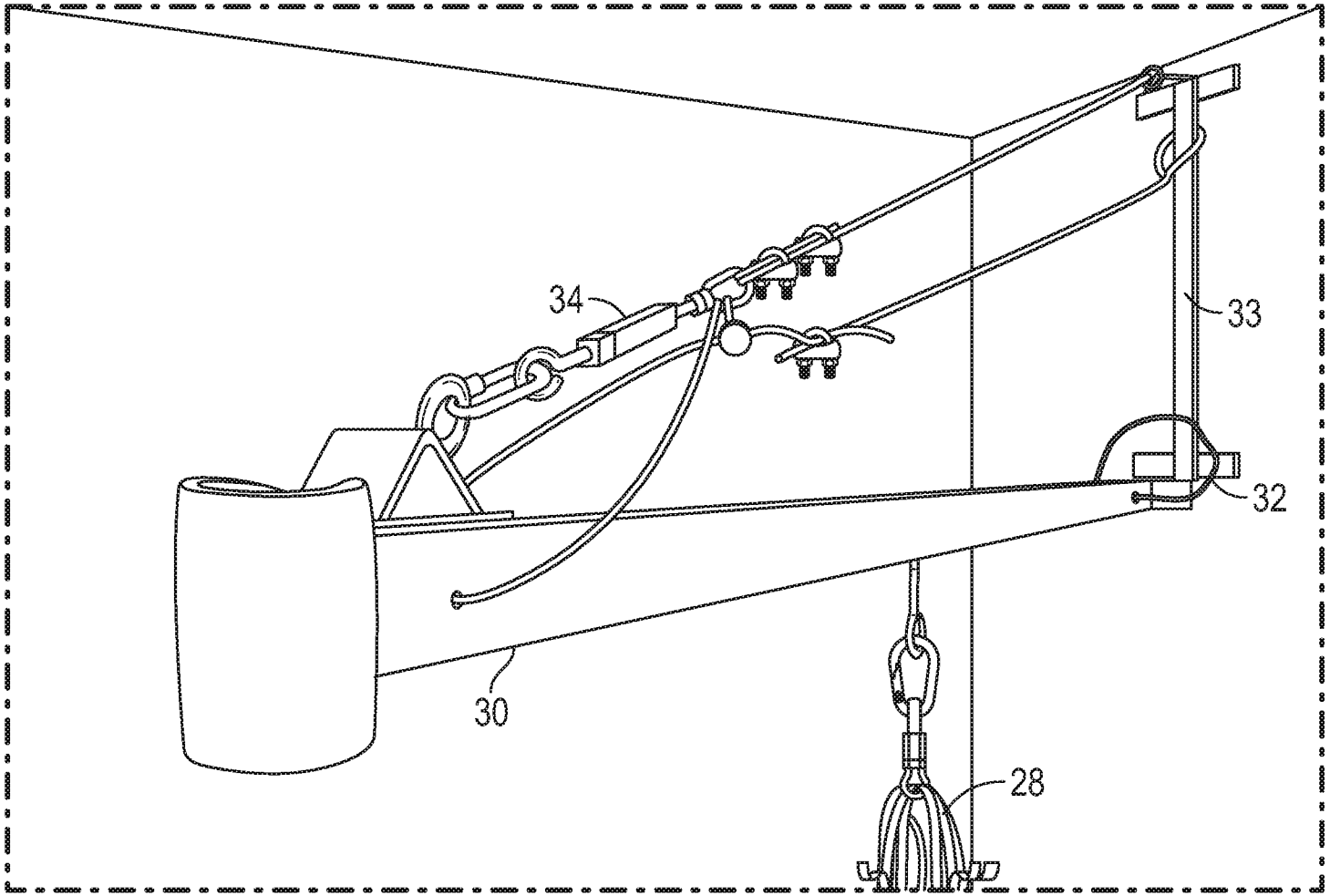
FIG. 3 illustrates an implementation of a crane configuration of a body weight support system.

Referring to FIG. 3, an implementation of a crane configuration of a body weight support system is illustrated. As illustrated, a cart 28 may be coupled to an arm 30 of the crane. In various implementations, the arm 30 may extend outwards from a wall or other support structure. In various implementations, the cart 28 may be configured to slide along a horizontal plane of the arm 30, as the cart 28 moves towards, or away from, the wall. As illustrated, the crane may include a rotatable portion 32. As illustrated, the rotatable portion 32 may couple to a wall mount 33. In various implementations, the rotatable portion 32 may be configured to move the arm 30 of the crane along a z-axis with respect to the wall. As illustrated, the crane may also include supports 34. In various implementations, the supports 34 may be configured to couple with an outer tip of the arm 30 and with the wall mount 33. In other various implementations, the supports 34 may be coupled to the wall itself. In various implementations, by non-limiting example, the supports 34 may be constructed out of cables, wires, or may be another rigid arm of the crane, constructed from metal, plastic, or any other material capable of bearing weight.

Figure 4:
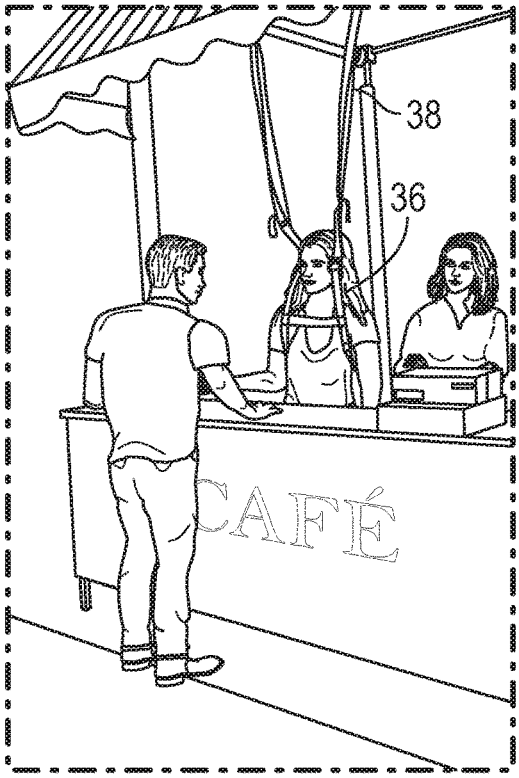
FIG. 4 illustrates an implementation of a multi-room harness system used in a work environment.

Referring to FIG. 4, an implementation of a multi-room harness system used in a work environment is illustrated. As illustrated, a cart 36 may be configured to hold the weight of a person in a work environment. As illustrated, the multi-room harness system 38 may be configured to couple to a ceiling. In other various implementations, by non-limiting example, the multi-room harness system 38 may be configured to couple to a wall, support structure, table, or any other structure. In various implementations, the multi-room harness system may be configured to allow the person to move from room to room of the work environment. Examples of the modes of movement are described elsewhere in this document.

Figure 5:
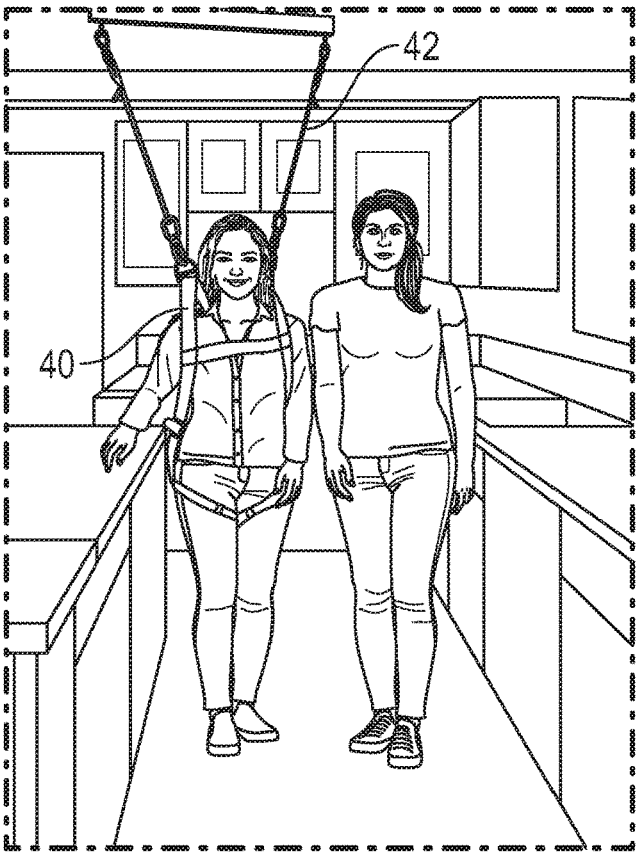
FIG. 5 illustrates an implementation of a multi-room harness system used in a home environment.

Referring to FIG. 5, an implementation of a multi-room harness system used in a home environment is illustrated. As illustrated, a cart 40 may be configured to hold the weight of a person in a home environment (the cart 40 taking the form of a harness coupled to the person). As illustrated, the multi-room harness system 42 may be configured to couple to a ceiling. In other various implementations, the multi-room harness system 42 may be configured to couple to a wall, support structure, table, or any other structure. In various implementations, the multi-room harness system may be configured to allow the person to move from room to room of the home environment. Examples of the modes of movement are described elsewhere in this document.

Figure 6:
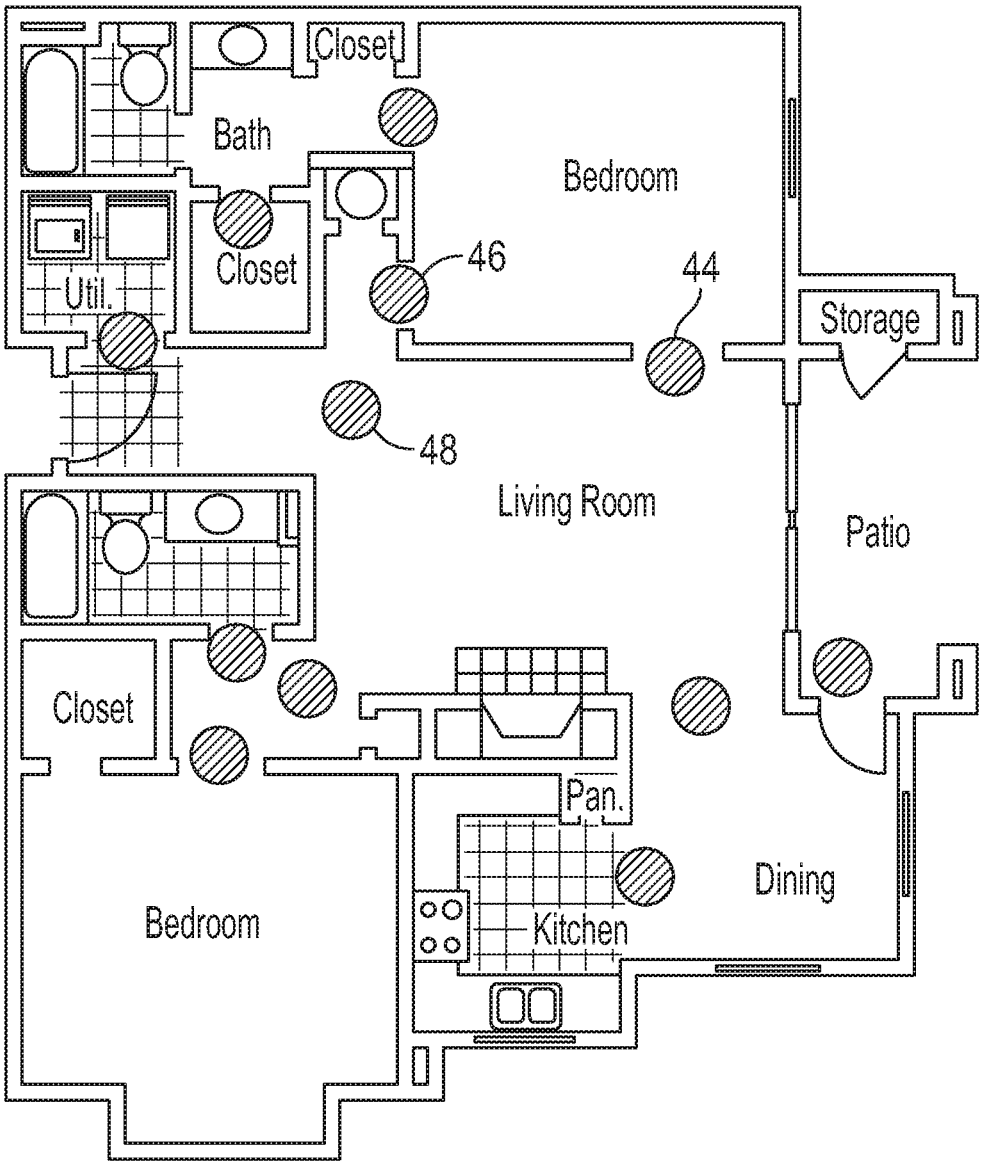
FIG. 6 illustrates an implementation of interconnected track systems spanning multiple rooms of a house.

Referring to FIG. 6, a diagram implementation of interconnected track systems spanning multiple rooms of a house is illustrated. As illustrated, each room may have multiple entries and exits. As illustrated, a multi-room harness system may include a number of transition points. In various implementations, each room may include a track system, including I-beams, and a trolley specific to that room. In other various implementations, one trolley may move from room to room. In various implementations, to enable a person to move between rooms while being supported by the harness system, the trolley of one room's track system must line up with the trolley of the other room's track system. In various implementations, a first group of tracks may make up a first track system in a first room. In such implementations, a trolley, carrying a cart, may then be moveably coupled to a track of the track system of the first room and may move along a horizontal plane of the track. In such implementations, the trolley may be configured to move the cart along each track of the first track system, and may transfer the cart from the first track system to a second track system in a second room.

As one non-limiting example, a person may be supported by a harness system in the living room. The person may enter into the upper bedroom by way of a first room transition point 44, as illustrated in FIG. 6. The trolley in the living room would then be left at the first room transition point 44 and a cart would be transferred to the trolley of the upper bedroom. The person may then exit the upper bedroom into a hallway by way of a second room transition point 46. The trolley in the upper bedroom would then be left at the second room transition point 46 and the cart would be transferred to a trolley in the hallway.

The person may then move to the living room by way of a third room transition point 48. In various implementations, a low-power motor system may be incorporated into the harness system to transfer the trolley between entries or exits of a room. In such implementations, sensors/detectors may be placed on each trolley to allow a centralized system to track the trolley movement within each room. The system may include a path planning algorithm that automatically moves the trolley in the adjacent room when the system detects that the person is nearing a specific entryway. The path planning algorithms to control trolley movement when a person is not using that room's cart may be balanced between measures of predictability, speed, and overall energy use. Predictability may be established by the measured time that the person must wait for the next room's trolley to respond and meet the person at the doorway. The speed of trolley movement may be measured by the time it takes the trolley to move one linear foot when not supporting the person. In various implementations, the speed of the trolley may not exceed the speed of the person in the harness system. Overall energy may also take into consideration both the energy consumed and the noise and/or annoyance factor of the system. In various implementations, the system will ensure the trolleys are at the appropriate entryways without constantly moving trolleys in all the rooms, thus creating noise and annoyance to the person or the person's caregiver. By moving the trolleys when not in use by the person, the system can ensure there will be trolleys at the appropriate entryways to facilitate between-room travel by the person. In various implementations, a call button accessible by the person utilizing the harness system may be used to signal a trolley of another room to move to a specific door.

In other various implementations, the harness system may include instrumentation including, by non-limiting example, motion and position sensors. Such sensors may be able to identify and monitor, by non-limiting example, the use of the harness system, as well as a person's ability to move within the harness system, and the movement and position of the harness system, the trolley, the cart, or other elements of the multi-room harness system.

In various implementations, the person may also utilize a wearable device. In various implementations, the data from the wearable device may be time-synchronized with sensors incorporated within the harness system so that data gathered from the person or data from the harness can be categorized as "in harness" or "out of harness." The data may be stored on the wearable device and may, in various implementations, be transmitted wirelessly or using a wired network to a database repository which may be accessed by a physician or other caregiver away from the home. Further, the system may include algorithms to classify the types of activities a person is doing within the harness. The algorithms may be developed using and operate using data from the motion sensors/detectors coupled to any element of the harness system and/or the person. In various implementations, the algorithms may be developed through video recording a set of volunteers doing a predefined set of activities. The video footage and the data from the wearable device or sensor within the harness system may then be time and/or manually synchronized, and video based analysis may be used to create the algorithms to identify which data points measured by the wearable device or sensor within the harness system correspond to what physical activities/physical positions of the person while in the harness. Other techniques may be used including machine learning and artificial intelligence systems including, by non-limiting example, neural networks, decision trees, classifiers, and other machine-based data analysis and learning, and modeling techniques and systems.

Figure 7:
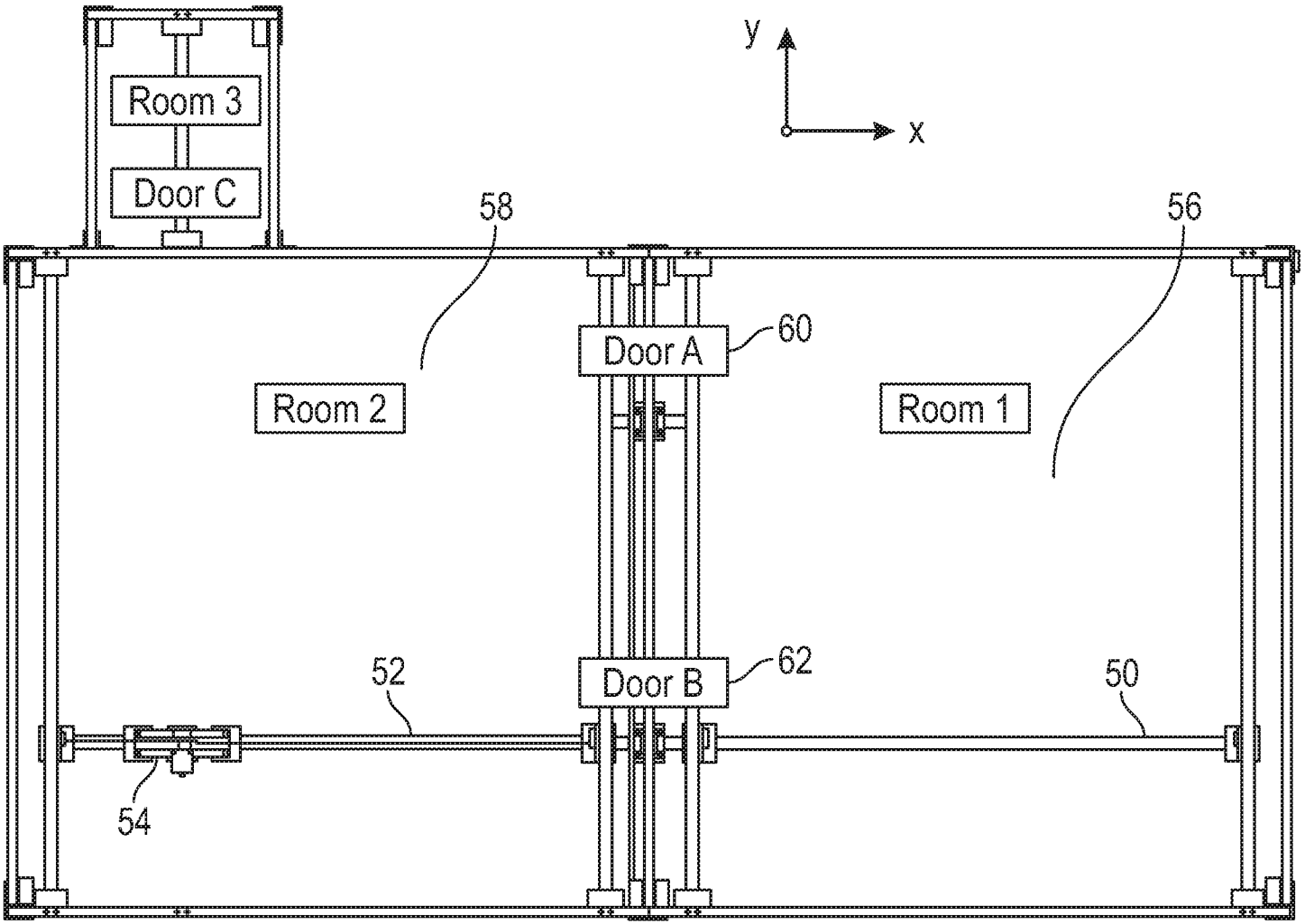
FIG. 7 illustrates a top view of a track system with I-beams.

Referring to FIG. 7, a top view of a track system with I-beams is illustrated. As illustrated, a first I-beam 50 is configured to couple to a second I-beam 52. As illustrated, a trolley 54 is configured to move along the I-beams 50, 52. In various implementations, the trolley 54 may be motorized, or it may be operated manually. In various implementations, the trolley 54 may be configured to couple to a cart. As illustrated, the first I-beam 50 is in a first room 56, and the second I-beam 52 is in a second room 58. In various implementations, the first I-beam 50 and the second I-beam 52 may be configured to meet at a second door 62. In various implementations, there may be another set of I-beams that meet at a first door 60, or the I-beams may move to meet at the first door 60.

Figure 8:
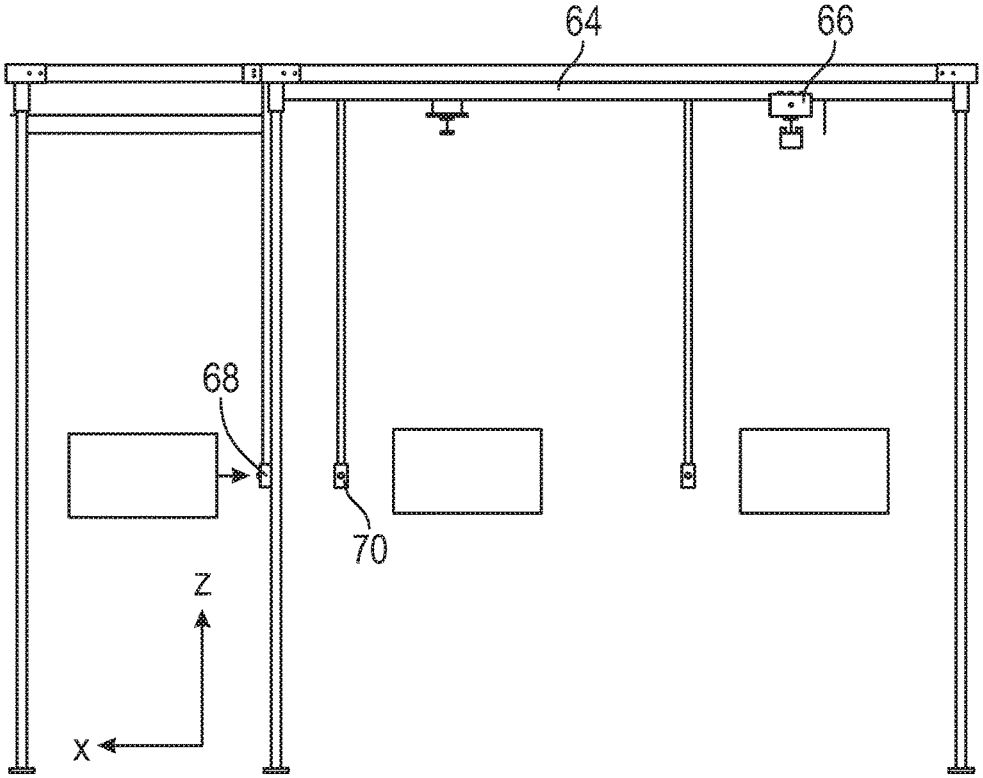
FIG. 8 illustrates a side view of a track system with I-beams and a trolley.

Referring to FIG. 8, a side view of a track system with I-beams and a trolley is illustrated. As illustrated, an I-beam 64 may be coupled to a ceiling of a room. As illustrated, a trolley 66 may be configured to move along the I-beam 64. As illustrated, the track system may include a rotation button 68 that may be configured to control a rotation of the trolley 66 or the I-beam 64. As illustrated, the track system may include a call button 70 that is configured to move the trolley 66 to a desired location when activated by a person. In various implementations, the rotation button 68 and the call button 70 may facilitate the movement and transition of the trolley 66 or a cart between rooms.

In various implementations, the trolley 66 may be operated using a motor. In such implementations, the motor may be controlled using a microcontroller or other electronic control system. In specific implementations, the microcontroller may be configured to receive signals from the call button 70, rotation button 68, or other computing device capable of receiving user input. In various implementations, the microcontroller may be configured to send and/or receive electronic signals from the motor, the trolley 66, or a computing device coupled with the trolley 66. In such implementations, the electronic signals may be sent or received by wired and/or wireless connections, and in digital and/or analog form. In such implementations, the microcontroller may be configured to control the movement of the trolley 66 or the I-beams. In various implementations, the microcontroller may electronically communicate with a centralized system. In such implementations, the centralized system may be configured to coordinate the movement of all elements of the multi-room harness system, and it may store data on the movement of all the elements of the multi-room harness system. The data collected may then be used to move the elements of the multi-room harness system, such as the motor, trolley 66, or I-beams, in a predictive fashion, based upon a computed analysis of the previous use of the system. In such implementations, sensors may be used, in addition to the call button 70 and rotation button 68, to collect the data. In other implementations, the centralized system or the microcontroller may be programmable. In various implementations, the centralized system may be located within the environment where the multi-room harness system is installed, or it may be located remotely, or in another physical location, whereby the microcontroller may be configured to electronically communicate with the centralized system via a web server or other connection.

Figure 9:
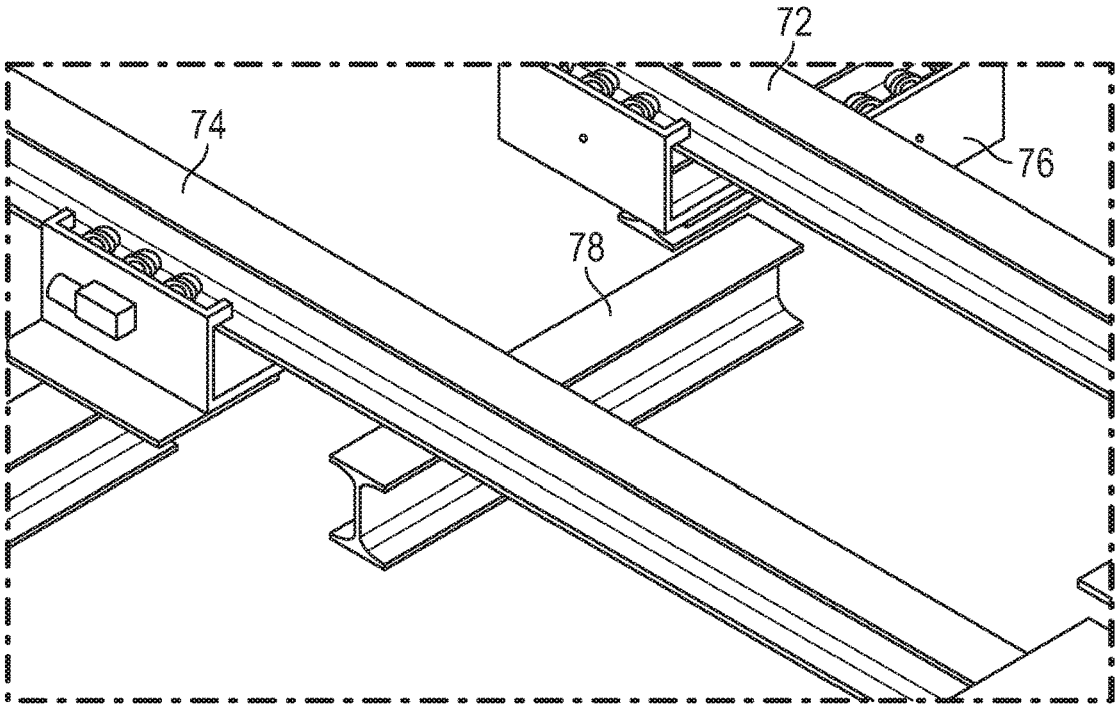
FIG. 9 illustrates a first I-beam state as a first I-beam moves towards a door with a trolley.

Referring to FIG. 9, a first I-beam state as a first I-beam moves towards a door with a trolley is illustrated. As illustrated, a first I-beam 72 may move towards a door 78 and a second I-beam 74. As illustrated, a trolley 76 may move along a same plane of the first I-beam 72. In various implementations, the first I-beam 72 may be configured to couple to the second I-beam 74. In other various implementations, the first I-beam 72, or track, may be configured to be rotationally alignable with the second I-beam, or track. In various implementations, one or more trolleys may be used between multiple rooms and portions of the track may move to align the track with the door and the track of the adjacent room.

Figure 10:
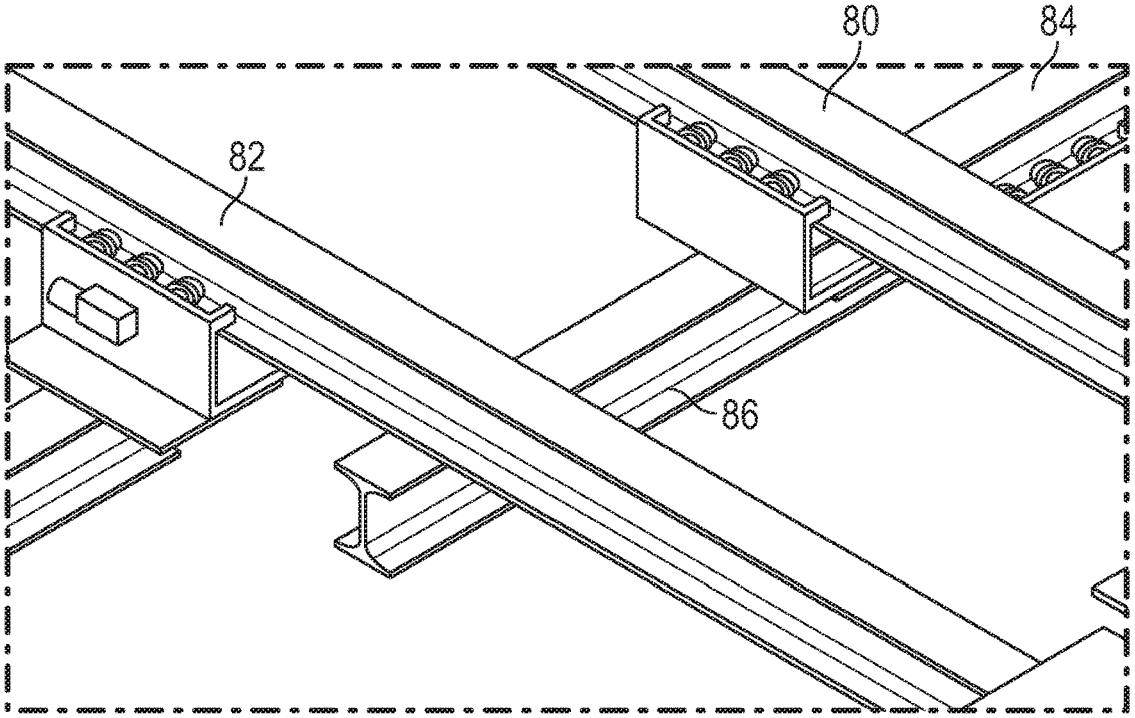
FIG. 10 illustrates a second I-beam state as the first I-beam reaches the door.

Referring to FIG. 10, a second I-beam state as the first I-beam reaches the door is illustrated. As illustrated, a first I-beam 80 reaches a door 86. As illustrated, the first I-beam 80 and a second I-beam 82 become closer to being in alignment with one another, and a trolley 84 moves closer to the second I-beam 82.

Figure 11:
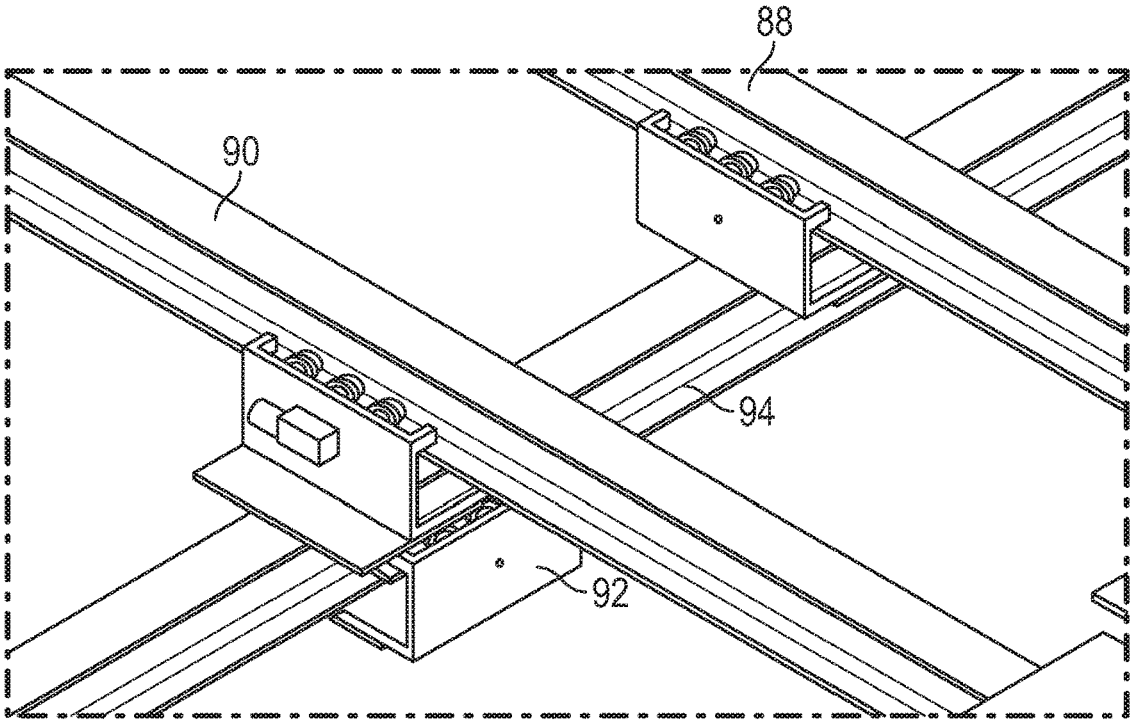
FIG. 11 illustrates a third I-beam state as a second I-beam moves to meet the first I-beam at the door to receive the trolley.

Referring to FIG. 11, a third I-beam state is illustrated as a second I-beam moves to meet the first I-beam at the door to receive the trolley. As illustrated, a second I-beam 90 aligns with a first I-beam 88 at a door 94. As illustrated, a trolley 92 may now pass between the first I-beam 88 and the second I-beam 90. In various implementations, the trolley 92 may be configured to transfer a cart from the second I-beam 90 to the first I-beam 88. In other various implementations, the trolley 92 may be configured to transfer the cart from the first I-beam 88 to the second I-beam 90.

The harness system used for supporting individuals may be made of various materials including, by non-limiting example, cloth, polymers, plastics, metals, composites, and other various materials designed to support a person's body and body weight. Those of ordinary skill in the art will readily be able to select appropriate materials and manufacture these products from the disclosures provided herein.

Figure 12:
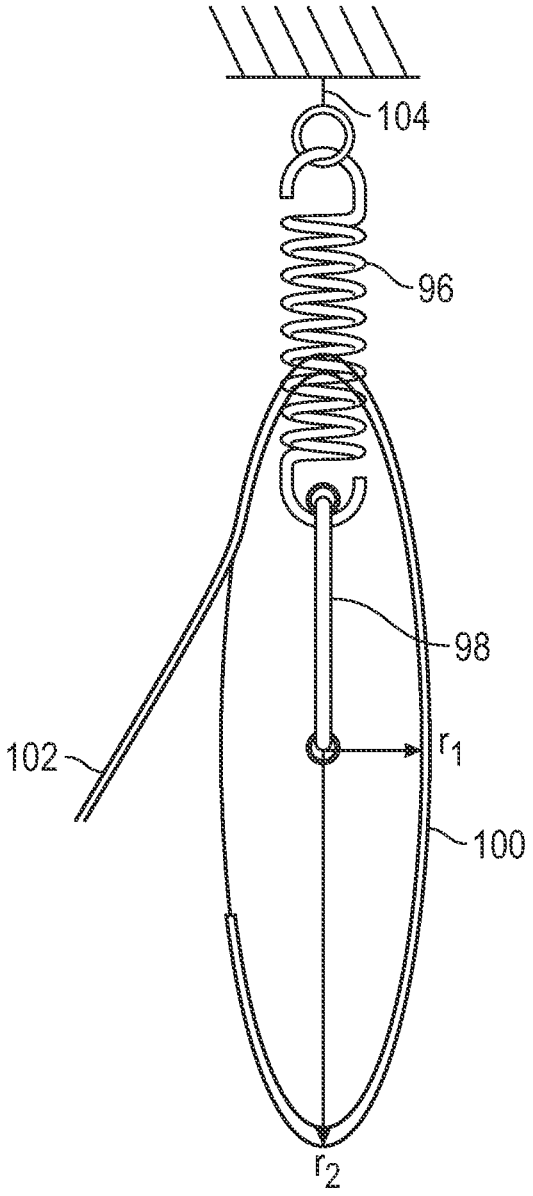
FIG. 12 illustrates an implementation of a spring to capstan system with a cam in a neutral upright position.

Referring to FIG. 12, an implementation of a spring to capstan system with a cam is illustrated in a neutral upright position. As discussed in Appendix B to U.S. Provisional Patent Application 62/657,568 (the '568 Application) previously incorporated by reference, the system includes a spring 96 that has the same −kx properties as other springs disclosed in this document and the '568 Application. The spring 96 is coupled to a capstan 98 which is rotatably coupled with a cam 100. Because the spring 96 is coupled to the capstan 98 instead of directly to the cam 100, the force generated by spring is applied as a torque to the capstan. As illustrated in FIG. 12, a cable 102 is attached to the cam 100 and wraps and unwraps around the cam 100 as the system is used as part of a body weight support system. The spring 96 is attached to a trolley 104 like any trolley implementation disclosed in this document. As illustrated in FIG. 12 and disclosed in the '568 Application, the cam 100 is four times as tall in the neutral position as it is wide and can correspondingly be mathematically modeled as a simple stretched circle (ellipse).

As disclosed in the '568 Application, the variable radius length as a function of the rotational position of the cam to cable intersection and the arclength (length) of cable wrapped around the cam as a function of the rotation angle θ of the cam from the horizontal axis to cam's major axis (the major axis of the elliptical cam 100, shown by $r_2$ with the minor axis being $r_1$) is represented using the following equations:

$$\Delta_{l\theta}=\sqrt{r_{\theta+1}^2+r^2-(2r_{\theta+1}r_1\cos d(\theta_{\theta+1}-\theta_\theta))}$$

$$arclength(\theta) = \sum_{\theta}^{end} \Delta_{l\theta}$$

The support force provided to the harness worn by the user by the system of FIG. 12 can then be calculated using the following equation:

$$F = kr_{spring}^2 * 2\pi \frac{\theta + init_{spring}}{360} * \frac{1}{r}$$

The foregoing equations can be used to calculate the force applied to the harness and the length of cable wrapped around the cam 100 (and the corresponding physical position of the harness) based on the illustrated physical proportions of the system illustrated in FIG. 12 during operation of the system while it applies assisting force to a user coupled with harness to a trolley.

In places where the description above refers to particular implementations of a multi-room in-home harness system and implementing components, sub-components, methods and sub-methods, it should be readily apparent that a number of modifications may be made without departing from the spirit thereof and that these implementations, implementing components, sub-components, methods and sub-methods may be applied to other multi-room in-home harness systems.

What is claimed is:

1. A multi-room harness system, comprising:

a first plurality of tracks comprising a first track system in a first room;

a trolley configured to moveably couple to a track of the first plurality of tracks and move along a horizontal plane of the track; and a cart coupled to the trolley; and a body weight support system configured to support the weight of a person, the body weight support system comprising a spring coupled to a capstan coupled to a cam by with a cable wrapped around the cam, where the cam is substantially four times as tall as the cam is wide;

wherein the trolley is configured to move the cart along each track of the first plurality of tracks and is also configured to transfer the cart from the first plurality of tracks to a second plurality of tracks in a second room.

2. The system of claim 1, wherein the trolley is further configured to move the cart along each track of the second plurality of tracks in the second room.

3. The system of claim 1, wherein the trolley comprises a motor, the motor configured to move the trolley along the horizontal plane of the track.

4. The system of claim 3, wherein the motor is controlled using a microcontroller.

5. The system of claim 1, wherein the first plurality of tracks comprises a first plurality of I-beams, wherein a first I-beam of the first plurality of I-beams is configured to couple to a second I-beam of the first plurality of I-beams.

6. The system of claim 5, wherein the second plurality of tracks comprises a second plurality of I-beams, where a first I-beam of the second plurality of I-beams is configured to couple to a second I-beam of the second plurality of I-beams and is configured to couple to the second I-beam of the first plurality of I-beams.

7. The system of claim 6, wherein the trolley is configured to transfer the cart from the second I-beam of the first plurality of I-beams to the first I-beam of the second plurality of I-beams.

8. A multi-room harness system, comprising:

a first plurality of I-beams in a first room, wherein a first I-beam of the plurality of I-beams is configured to couple to a second I-beam of the first plurality of I-beams;

a trolley configured to moveably couple to an I-beam of the first plurality of I-beams and move along a horizontal plane of the I-beam; and a cart coupled to the trolley; and a body weight support system configured to support the weight of a person, the body weight support system comprising a spring coupled to a capstan coupled to a cam with a cable wrapped around the cam, where the cam is substantially four times as tall as the cam is wide;

wherein the trolley is configured to move the cart along the first I-beam of the plurality of I-beams and is also configured to transfer the cart from the second I-beam of the first plurality of I-beams to a first I-beam of a second plurality of I-beams in a second room.

9. The system of claim 8, wherein the trolley comprises a motor, the motor configured to move the trolley along the horizontal plane of the I-beam.

10. The system of claim 9, wherein the motor is controlled using a microcontroller.

11. The system of claim 8, further comprising a plurality of sensors configured to sense a movement and a position of the cart.

12. A multi-room harness system, comprising:

a first plurality of tracks comprising a first track system in a first room;

a trolley configured to moveably couple to a track of the first plurality of tracks and move along a horizontal plane of the track; and a cart coupled to the trolley; and a body weight support system configured to support the weight of a person, the body weight support system comprising a spring coupled to a capstan coupled to a cam with a cable wrapped around the cam, where the cam is substantially four times as tall as the cam is wide;

wherein the first plurality of tracks is configured to be alignable with a second plurality of tracks in a second room to allow the trolley to transfer the cart from the first plurality of tracks to the second plurality of tracks.

13. The system of claim 12, wherein the track of the first plurality of tracks is rotationally alignable with a track of the second plurality of tracks.

14. The system of claim 12, further comprising a plurality of sensors configured to sense a movement and a position of the cart.

15. The system of claim 12, wherein the trolley comprises a motor, the motor configured to move the trolley along the horizontal plane of the track.

16. The system of claim 12, wherein the first plurality of tracks comprises a first plurality of I-beams, wherein a first I-beam of the first plurality of I-beams is configured to couple to a second I-beam of the first plurality of I-beams.

17. The system of claim 16, wherein the second plurality of tracks comprises a second plurality of I-beams, where a first I-beam of the second plurality of I-beams is configured to couple to a second I-beam of the second plurality of I-beams and is configured to couple to the second I-beam of the first plurality of I-beams.

18. The system of claim 17, wherein the trolley is configured to transfer the cart from the second I-beam of the first plurality of I-beams to the first I-beam of the second plurality of I-beams.

* * * * *